US009940857B2

(12) United States Patent
Heater et al.

(10) Patent No.: US 9,940,857 B2
(45) Date of Patent: Apr. 10, 2018

(54) LED CONSOLE ASSEMBLY WITH LIGHT REFLECTOR

(71) Applicant: WHIRLPOOL CORPORATION, Benton Harbor, MI (US)

(72) Inventors: Timothy E. Heater, Hartford, MI (US); Eric J. Schuh, Stevensville, MI (US); Sithaarth T. Subramaniyam, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 107 days.

(21) Appl. No.: 14/943,355

(22) Filed: Nov. 17, 2015

(65) Prior Publication Data

US 2016/0071443 A1 Mar. 10, 2016

Related U.S. Application Data

(63) Continuation of application No. 13/967,427, filed on Aug. 15, 2013, now Pat. No. 9,220,394.

(51) Int. Cl.

| | |
|---|---|
| ***A47L 15/00*** | (2006.01) |
| ***D06F 39/00*** | (2006.01) |
| ***G09F 13/06*** | (2006.01) |
| ***A47L 15/42*** | (2006.01) |
| ***F21V 33/00*** | (2006.01) |
| ***G09F 13/14*** | (2006.01) |
| *G09F 13/04* | (2006.01) |

(52) U.S. Cl.

CPC ..... *G09F 13/06* (2013.01); *A47L 15/4293* (2013.01); *D06F 39/005* (2013.01); *F21V 33/0044* (2013.01); *G09F 13/14* (2013.01); *G09F 2013/0422* (2013.01); *G09F 2013/142* (2013.01)

(58) Field of Classification Search

CPC .. H01H 19/025; G05G 1/015; F21V 33/0044; D06F 39/005; A47L 15/4293

See application file for complete search history.

(56) References Cited

U.S. PATENT DOCUMENTS

| | | | | |
|---|---|---|---|---|
| 3,858,341 | A | 1/1975 | Wakabayashi | |
| 4,818,980 | A | 4/1989 | Strosser et al. | |
| 4,990,772 | A | 2/1991 | Rosenthal | |
| 5,105,568 | A | 4/1992 | Branning | |
| 5,694,793 | A * | 12/1997 | Nishimura | D06F 39/005 68/12.27 |
| 5,747,757 | A | 5/1998 | Van Zeeland et al. | |
| 5,833,903 | A | 11/1998 | Centofante | |
| 6,137,224 | A | 10/2000 | Centofante | |
| 6,280,054 | B1 | 8/2001 | Cassarly et al. | |
| 6,617,786 | B1 | 9/2003 | Centofante | |
| 6,750,407 | B2 | 6/2004 | Song et al. | |
| 6,897,390 | B2 | 5/2005 | Caldwell et al. | |
| 6,967,299 | B2 | 11/2005 | Howie et al. | |

(Continued)

FOREIGN PATENT DOCUMENTS

EP 2415925 A1 2/2012

*Primary Examiner* — Peggy Neils

(57) ABSTRACT

A console assembly for an appliance has a light transmissive indicia assembly having at least one indicator and one operator control, a printed circuit assembly (PCA) mounted to the indicia assembly with touch circuit and light emitting diodes (LEDs) mounted to both sides of the PCA, and a light reflector disposed adjacent to the PCA and the LEDs.

19 Claims, 8 Drawing Sheets

(56) References Cited

U.S. PATENT DOCUMENTS

| | | | | |
|---|---|---|---|---|
| 7,211,755 | B1 | 5/2007 | Wang et al. | |
| 7,418,839 | B2 | 9/2008 | Kwon et al. | |
| 7,517,103 | B2 | 4/2009 | Furuya et al. | |
| 7,619,881 | B1 | 11/2009 | Granville et al. | |
| 7,637,631 | B2 | 12/2009 | McDermott et al. | |
| 7,700,900 | B2 | 4/2010 | Geiger et al. | |
| 7,752,871 | B2 | 7/2010 | Cho et al. | |
| 7,928,855 | B2 * | 4/2011 | Gault | A47L 15/4293 134/57 D |
| 8,136,960 | B2 | 3/2012 | Wu | |
| 8,178,802 | B2 | 5/2012 | Roose et al. | |
| 8,356,913 | B2 * | 1/2013 | Nagai | H01L 25/0753 362/240 |
| 8,564,004 | B2 | 10/2013 | Tarsa et al. | |
| 8,807,770 | B2 | 8/2014 | Didat et al. | |
| 8,813,399 | B2 | 8/2014 | Miedema et al. | |
| 2002/0024808 | A1 | 2/2002 | Suehiro et al. | |
| 2003/0002281 | A1 | 1/2003 | Suehiro | |
| 2005/0083449 | A1 | 4/2005 | Morsch | |
| 2007/0285917 | A1 | 12/2007 | Wadia et al. | |
| 2009/0002980 | A1 | 1/2009 | Michael | |
| 2010/0218565 | A1 | 9/2010 | Wan et al. | |
| 2010/0224469 | A1 | 9/2010 | Byrne et al. | |
| 2011/0134627 | A1 | 6/2011 | Hamlin et al. | |
| 2011/0181516 | A1 * | 7/2011 | Mallory | A47L 15/4293 345/173 |
| 2011/0214978 | A1 | 9/2011 | Byrne et al. | |
| 2012/0118601 | A1 | 5/2012 | Hite et al. | |
| 2012/0314348 | A1 | 12/2012 | Moncrieff | |
| 2012/0314380 | A1 | 12/2012 | Moncrieff | |
| 2013/0163227 | A1 | 6/2013 | Hirano | |
| 2013/0294047 | A1 | 11/2013 | Moon et al. | |
| 2014/0192013 | A1 | 7/2014 | Lubert et al. | |

* cited by examiner

LED CONSOLE ASSEMBLY WITH LIGHT REFLECTOR

CROSS REFERENCE TO RELATED APPLICATIONS

This application is a continuation of U.S. patent application Ser. No. 13/967,427, filed Aug. 15, 2013, now U.S. Pat. No. 9,220,394 issued Dec. 29, 2015, which is incorporated herein by reference in its entirety.

BACKGROUND OF THE INVENTION

Home appliances are increasingly equipped with a greater number of user-selectable features, typically presented via a user interface. An appliance may have a console assembly with the user interface or control panel provided thereon for selecting or setting one or more of the user-selectable features. The user interface may be coupled to a controller. The console assembly may be provided with illumination when one or more of the user-selectable features is selected or set.

BRIEF DESCRIPTION OF THE INVENTION

The invention, in one aspect, relates to a console assembly for an appliance comprising a light transmissive indicia assembly having at least one indicator and at least one operator control; a printed circuit assembly (PCA) mounted to the indicia assembly, having a touch circuit on a first side adjacent to the indicia assembly, operatively coupled with the at least one operator control on the indicia assembly, and further having at least one light emitting diode (LED) on a second side opposite the first side, and at least one opening through the PCA from the second side to the first side; a light reflector disposed adjacent to the second side of the PCA and the at least one LED, wherein light from the LED is reflected by the light reflector through the at least one opening of the PCA and through the indicia assembly; and a console shell disposed adjacent to the light reflector, and further coupled to the indicia assembly.

DESCRIPTION OF EMBODIMENTS OF THE INVENTION

Figure 1:
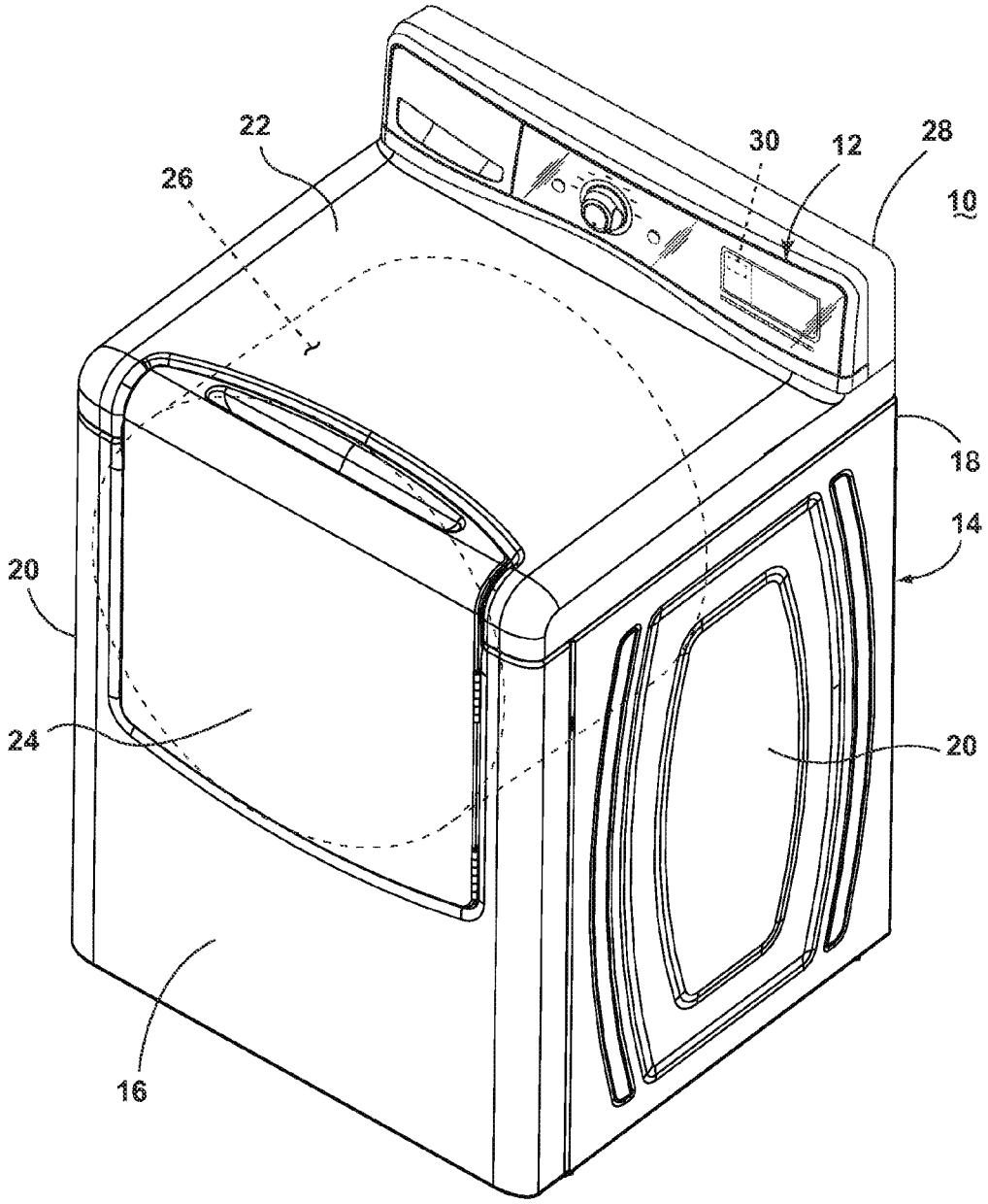
FIG. 1 is a perspective view of an appliance in the form of a washing machine having a console assembly according to a first embodiment of the invention.

FIG. 1 is a perspective view of an appliance 10 having a console assembly 12 according to a first embodiment of the invention. As illustrated, the appliance 10 may be a washing machine, although the console assembly 12 may be included in other types of appliances, non-limiting examples of which may include clothes dryers, laundry drying machines, tumbling or stationary refreshing/revitalizing machines, extractors, non-aqueous washing apparatus, dishwashers, refrigerators, freezers, conventional ovens, microwave ovens, stoves, beverage dispensers, and ranges. The console assembly also may be used in environments other than household appliances.

The appliance 10, which may include a structural support system comprising a cabinet 14 defined by a front wall 16, a rear wall 18, and a pair of side walls 20 supporting a top wall 22. The cabinet 14 may be a housing having a chassis and/or a frame, defining an interior enclosing components typically found in a conventional washing machine, such as motors, pumps, liquid supply system, dispensing system, recirculation and drain system, drive system, sensors, transducers, and the like. Such components will not be described further herein except as necessary for a complete understanding of the invention.

A door 24 may be hingedly mounted to the front wall 16 and may be selectively movable between opened and closed positions to close an opening in the front wall 16, which provides an access to the interior of the cabinet 14. A treating chamber 26 may be disposed within the interior of the cabinet 14. The top wall 22 may support or be formed with a backsplash 28.

The appliance 10 may further include a control system for controlling the operation of the appliance 10 to implement one or more cycles of operation. The control system may include a controller 30 located in the cabinet 14 or the backsplash 28 and the console assembly 12 that is operably coupled with the controller 30.

The console assembly 12 may be provided on an exterior portion of the appliance 10, such as on the front wall 16 of the cabinet 14 or, as illustrated, on the backsplash 28. As illustrated, the console assembly 12 may be integrated with the backsplash 28. Alternately, the console assembly 12 may be a separate piece from the backsplash 28.

The console assembly 12 may be operably coupled with the controller 30 for selecting and/or setting one or more user-selectable features or parameters. The particular user-selectable parameters will vary depending on the appliance 10. For the washing machine illustrated in FIG. 1, examples of user-selectable parameters may include cycle type (such as a normal, power wash, hand wash, wrinkle control or heavy duty cycle), load size (such as a small, medium, or large load), and fabric color (such as whites or colors).

Figure 2:
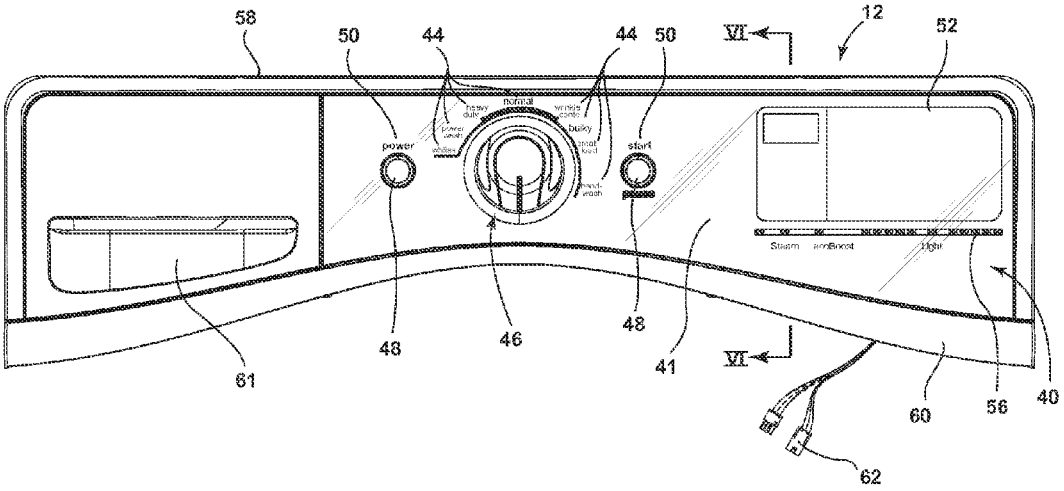
FIG. 2 is a front perspective view of the console assembly of FIG. 1, the console assembly having a parameter selector mounted on the front side of the console assembly.

FIG. 2 is a front perspective view of the console assembly 12 of FIG. 1. The console assembly 12 may include an indicia assembly 40. The indicia assembly 40 may include a front side 41 where multiple indicia 44 representing the user-selectable parameters may be disposed. The indicia assembly 40 may be an in-mold label, an in-mold decoration, printed glass, or the like; it is important that the indicia assembly be light transmissive. In other words, the indicia assembly 40 must be capable of allowing light to be transmitted through it. A parameter selector 46 may be configured to be rotatably coupled to the indicia assembly 40 and to move relative to the indicia 44 to select one of the indicia 44 such that a user may enter different types of information including, without limitation, cycle selection and cycle parameters, such as cycle options. As such, the indicia 44 may be arranged around the perimeter of the parameter selector 46 on the indicia assembly 40. In addition to the parameter selector 46, the indicia assembly 40 may include one or more buttons 48 for selecting and/or setting one or more of the user-selectable parameters indicated by additional indicia 50 on the indicia assembly 40. The indicia assembly 40 may further include a display panel 52 for selecting and/or displaying one or more of the user-selectable parameters indicated by additional indicia (not shown) or status of a cycle of operation on the display panel 52. As illustrated, one or more parameter selector 46 or buttons 48 may be coupled to the front side of the indicia assembly 40, while it is also possible that the front side of the indicia assembly 40 may be provided entirely with multiple indicia or other selectors that are co-planar with the front surface of the indicia assembly 40 such that no components are protruded from the front surface of the indicia assembly 40.

The indicia assembly 40 may yet further include a strip display 56 for setting and/or displaying one or more of the user-selectable parameters. It may be understood that the display panel 52 and the strip display 56 may include one or more illumination devices emanating a variety of colors and/or intensities for setting and/or displaying one or more of the user-selectable parameters.

The console assembly 12 may also include a console shell 58. The console shell 58 may be operably coupled to the rear side of the indicia assembly 40 to provide mechanical support to the indicia assembly 40. The console shell 58 may be integrated to the indicia assembly 40 by an attachment means which may include fasteners such as screws, bolts or nuts, heat staking, welding, snap fit, gluing, and the like.

The console assembly 12 may further include a support strip 60 on the bottom side of the indicia assembly 40. The support strip 60 may be separate from the console shell 58 while the support strip 60 may be molded together with the console shell 58. In case the support strip 60 is separated from the console shell 58, the support strip 60 may be coupled to the support strip 60 by an attachment means.

Connector 62 may be provided to the console assembly 12 for electrically coupling the console assembly 12 to other component of the appliance 10.

For the washing machine 10 illustrated in FIG. 1, the console assembly 12 may be optionally provided with a dispenser handle 61 for operating a dispenser for the washing machine, while the dispenser handle 61 may not be necessary in other appliances that do not require the dispenser. For example, the console assembly 12 for refrigerators, freezers, or ovens may not be provided with the dispenser handle 61.

Figure 3:
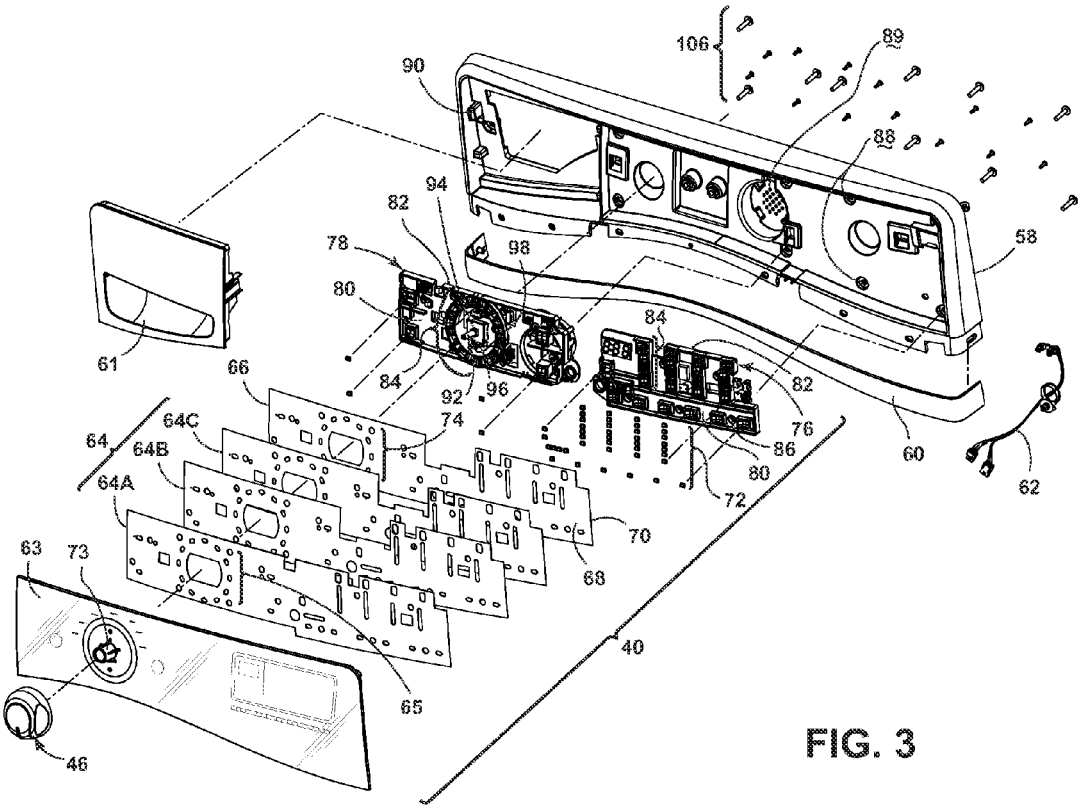
FIG. 3 is an exploded view of the console assembly of FIG. 2, where the console assembly may include an indicia assembly and a console shell.

FIG. 3 is an exploded view of the console assembly 12 of FIG. 2. The console assembly 12 may include the indicia assembly 40, which may include an in-mold layer (IML) 63, an adhesive layer 64, a printed circuit assembly (PCA) 66, a light reflector 68, 70, and at least one illumination device 72.

The IML 63 may include a stem 73 protruding from the first surface of the indicia assembly 40 for receiving the parameter selector 46. The IML 63 may comprise graphics that define or direct where light may be transmitted there through. The IML 63 may comprise polyvinyl chloride (PVC) or acrylonitrile butadiene styrene (ABS). While not shown in FIG. 2, the attachment means for the indicia assembly 40 may include a plurality of bores extending from the rear side for receiving fasteners for coupling the indicia assembly 40 and other components of the console assembly 12.

An adhesive layer 64 may be positioned immediately adjacent to the second side of the IML 63. The adhesive layer 64 includes first and second adhesive layers 64A, 64C, and a support 64B in between the first and second adhesive layers 64A, 64C. The first and second adhesive layers 64A, 64C may be in the form of a pressure sensitive adhesive (PSA). The support film 64B such as Mylar film, may be positioned between the first and second PSAs for providing stiffness of the adhesive layer 64, while in another embodiment the support film 64B may not be necessary.

The first adhesive layer 64A may be mechanically coupled to the second side of the IML 63, while the second adhesive layer 64C may be mechanically coupled to the PCA 66. The adhesive layer 64 may include one or more openings 65 through the adhesive layer 64 for providing holes for operably connecting components in the console assembly 12. Alternately the one more openings may be utilized in providing paths for light generated in the console assembly 12.

As illustrated, the PCA 66 may be positioned immediately next to the second adhesive layer 64C to be coupled with the IML 63. The PCA 66, having first and second sides 68, 70, may comprise at least one of rigid or semi-rigid material, and may include a multi layered printed circuit. The PCA 66 may comprise any suitable material for a printed circuit board, such as CEM-1 including cotton paper and epoxy, or it may include an FR4 epoxy resin and fiberglass or the like. The PCA 66 may include multi layered circuits with electric components such as integrated circuits (ICs), capacitors, resistors, or inductors, mounted on or embedded into the multi layered circuits.

One or more touch circuits (not shown) may be mounted to the first side 68 of the PCA 66 such that the touch circuit may face the second adhesive layer 64C of the adhesive layer 64. A plurality of illumination devices 72 mounted on the second side of the PCA 66 for providing illumination in a direction opposite the IML 63. Non-limiting examples of the illumination devices include light emitting diodes (LEDs) or other discrete light bulbs that may be separately mounted to the second side of the PCA 66 and separately controlled to be operational. In another embodiment, the illumination devices may comprise one illumination device with a plurality of illumination units, where each illumination unit may be selectively operable to provide illumination. The touch circuits mounted on the first side 68 of the PCA 66 may be electrically coupled to the illumination device 72. For example, the touch circuits may be electrically connected to the illumination device 72 via conductor layers formed in the multi layered PCA 66, which may be a well-known method.

It is noted that, in addition to the illumination devices 72, other electronic components may be mounted to the second side 70 of the PCA 66. For example, one or more components such as capacitors, resistors, connectors, and the like, may be mounted to the second side 70 of the PCA 66 for operating touch circuits or illumination devices 72.

The PCA 66 may also be provided with one or more openings 74 through the PCA 66 from the second side 70 to the first side 68. It may be noted that some of the openings 74 in the PCA 66 may be configured to overlap some of the openings 65 in the adhesive layer 64. At least a portion of the illumination devices 72 may be located adjacent to the openings 74. For example, some of the illumination devices 72 may be disposed around the periphery of the openings 74.

One or more light reflectors may be positioned adjacent to the PCA 66 for controlling the operation of illumination devices 72 toward the user. As illustrated, light reflectors 76, 78 may be disposed immediately adjacent to the PCA 66, and may comprise acrylonitrile butadiene styrene (ABS). Another material such as polypropylene (PP), polycarbonate (PC), or polystyrene (PS) may be used for light reflectors 76, 78.

The light reflectors 76, 78 may include first and second sides 80, 82, respectively, where a plurality of light cups 84 may be disposed on the first side 80 of the light reflectors 76, 78. Collectively, the light cups 84 may be disposed in the circular or linear form. Alternately, only one light cup 84 may be disposed. The light cups 84 may be in the form of a hollow dome, and positioned to align with the illumination devices 72 on the second side of the PCA 66 such that each illumination device 72 is received in the space defined by the three dimensional light cup 84 when the light reflectors 76, 78 are aligned to the PCA 66.

The light reflectors 76, 78 may further include one or more openings 86 through the light reflectors 76, 78 from the second side 82 to the first side 80. The openings 86 may couple the light reflectors 76, 78 with the IML 63.

The console shell 58 may be positioned adjacent to the light reflectors 76, 78 for providing mechanical support to the indicia assembly 40. The console shell 58 may include one or more openings 88 through the console shell 58 for receiving fasteners from the rear side of the console shell 58 to couple the console shell 58 to the indicia assembly 40. The openings 88 may also couple the parameter selector 46 to the console shell 58. The console shell 60 may further be provided with speaker holes 89 for providing audio signal from a speaker system (not shown) to the user according to a cycle of operation.

The console shell 58 may also be provided with a plurality of guides 90 to facilitate mechanically coupling the console shell 58 to the indicia assembly 40.

The connector 62 may electrically couple the console assembly 12 to other components in the appliance 10. The connector 62 may include pins and cords to couple the console shell 58 to at least one of the motor, sensors, dispensing system or controller according to a cycle of operation.

The selector PCA 92 may be provided to couple the parameter selector 44 to the console shell 58 for selecting a selectable parameter prior to or during a cycle of operation of the appliance 10. The selector PCA 92 may include a rigid or semi-rigid PCA 94 for receiving a stem 96 of the parameter selector 46, and a support plate 98 that electrically and mechanically couples the rigid or semi-rigid PCA 94 to the console shell 58. The selector PCA 92 may be coupled to the console shell 60 by means of one or more fasteners.

Figure 4:
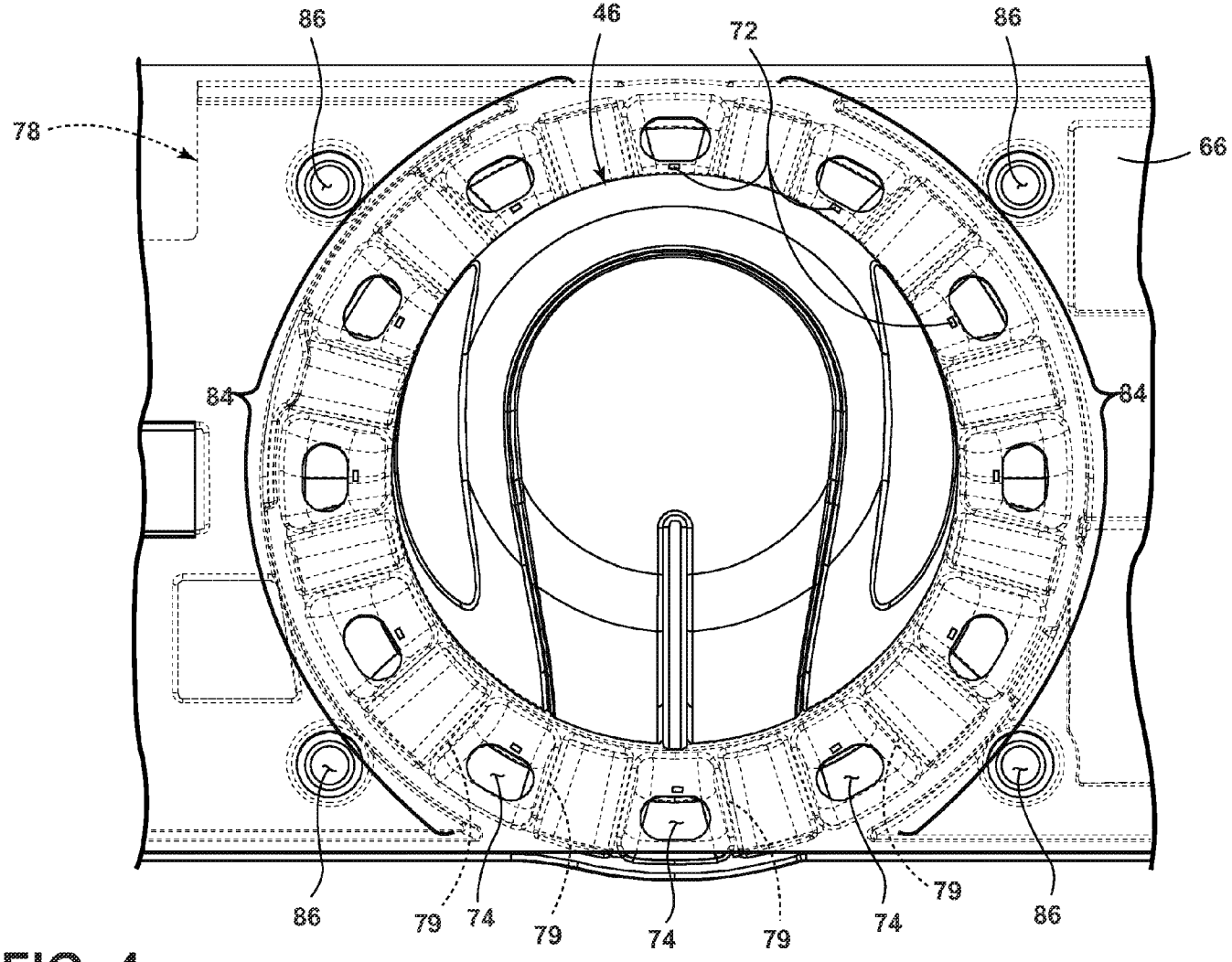
FIG. 4 is an enlarged plain view of the console assembly of FIG. 2, where the alignment of light cups in a light reflector with respect to illumination devices and openings of printed circuit assembly (PCA) are illustrated.
Figure 5:
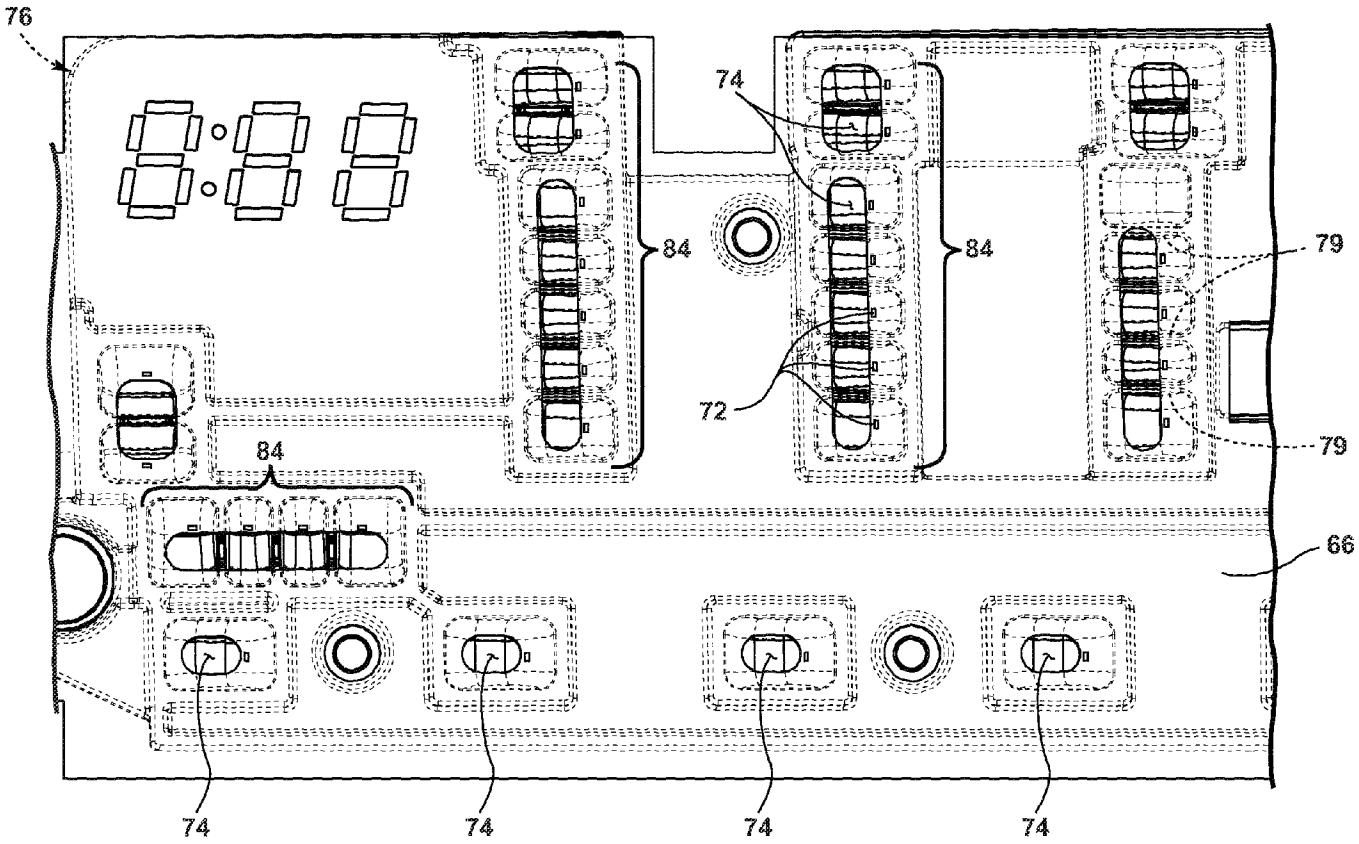
FIG. 5 is an enlarged plain view of the console assembly of FIG. 2, where the alignment of light cups in a light reflector with respect to illumination devices and openings of PCA are illustrated.

Referring to FIGS. 4 and 5, the alignment of light cups 84 in the light reflector 78 with respect to the illumination devices 72 and openings 74 formed in the PCA 66 is illustrated for light reflectors 76, 78, respectively. As illustrated in FIG. 4, light cups 84 may be arranged on the light reflector 78 such that light cups 84 may be disposed in the periphery of the parameter selector 46 when assembled. Each illumination device 72 and opening 74 may be confined within the space formed by the three dimensional wall 79 of the light cup 84. When each illumination device 72 is selectively activated, the light from each illumination device 72 may be supplied toward the wall 79 of the light cup 84, then reflected by the wall 79 toward the IML 63. Some of the reflected light may pass through opening 74 without being retarded by any light blocking medium, and reach to the light transmissive IML 63. The reflected light may further pass through the thickness of IML 63 to reach to the user.

It is to be understood that not all of the reflected light may pass through the opening 74. Instead, some portion of the reflected light may pass through the body of the PCA 66, adhesive layer 64, and the IML 63. Reflected light passing through the opening 74 may be combined with the reflected light passing through the PCA 66, adhesive layer 64, and IML 63, before they are noticed by the user in selecting and/or monitoring one or more selectable parameters.

FIG. 5 illustrates the alignment of light cups 84 in the light reflector 76 with respect to the illumination devices 72 and openings 74 formed in the PCA 66. As illustrated, a plurality of light cups 84 is linearly disposed with the light cups 84 sharing a wall between two adjacent light cups 84. The light cups 84 may be disposed either in vertical or horizontal directions. The openings 74 are aligned to the light cups 84 such that each opening 74 is optically coupled to the space 100 formed by the light cups 84. Similar to FIG. 4, illumination devices 72 may be disposed adjacent to the openings 74. It may be understood that each illumination device 72 is separately received in the space 100 formed by each light cup 84.

Figure 6:
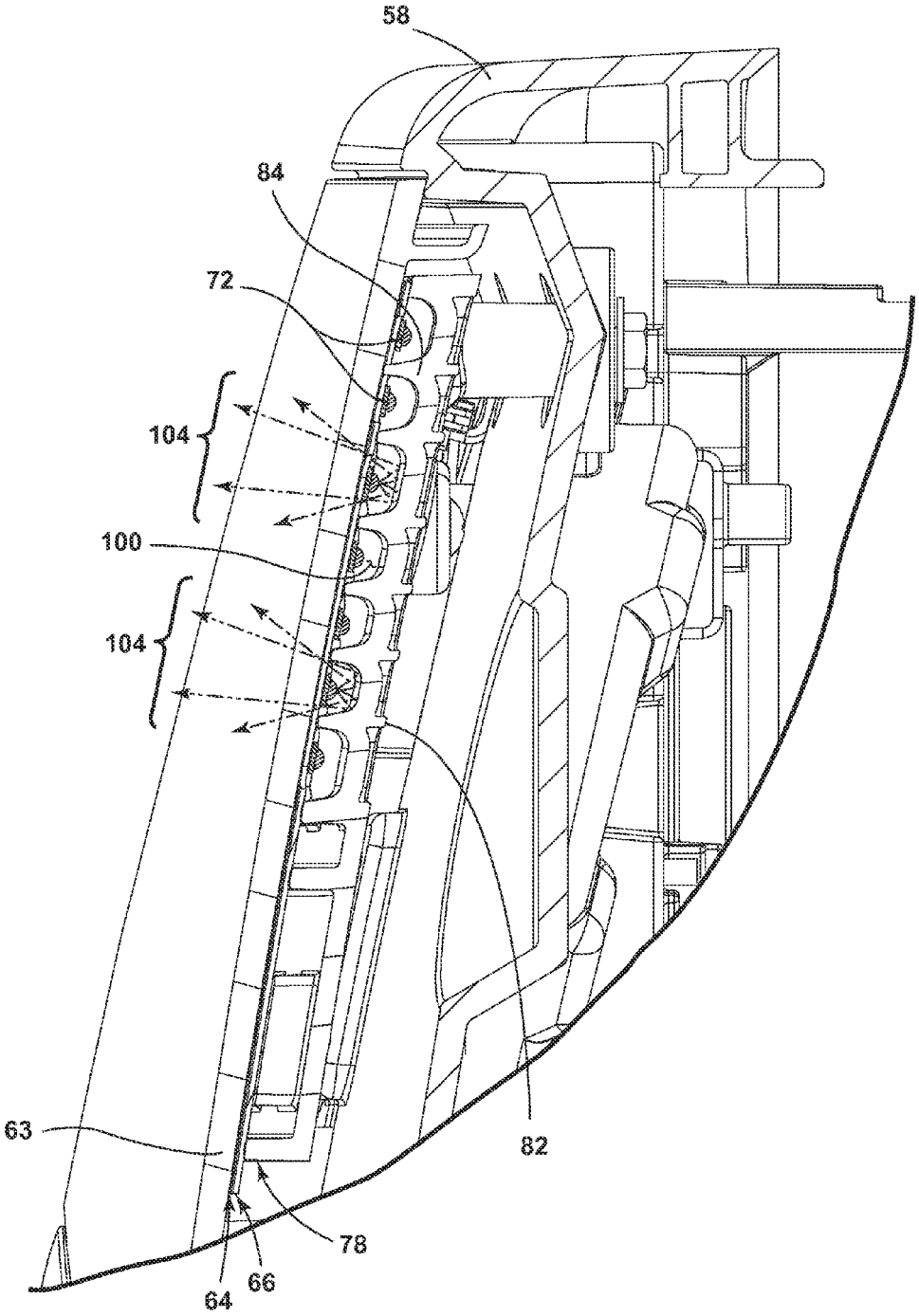
FIG. 6 is an enlarged cross-sectional view of the console assembly of FIG. 2 taken along line VI-VI, where the arrangement of illumination devices with respect to light reflector is illustrated.

Referring to FIG. 6, a cross-sectional view of the console assembly taken along line VI-VI of FIG. 2 is illustrated. As illustrated, each illumination device 72 is confined to the space 100 defined by each light cup 84 of the light reflector 80. The illumination device 72 may be selectively activated by the buttons (not shown here) or touch circuitry formed on the first side 68 of the PCA 66. The activation of the illumination device 72 by touch circuitry may be based on a mutual capacitance effect or a single capacitance effect, which is not germane to the claimed invention. When the illumination device 72 emits the illumination 104 toward the light cups 84, the reflective light cup 84 may reflect the illumination by the wall of the light cup 84. At least a portion of the reflected illumination 104 may pass through the openings 74, 65 formed in the PCA 66 and adhesive layer 64, respectively, and then light transmissive IML 63 while a remaining portion of the reflected illumination may pass through the PCA 66, adhesive layer 64, and IML 63. It will be understood that the graphics in the IML 63 or equivalent in the indicia assembly 40 define the openings through the light is transmitted.

As illustrated, due to the presence of the wall of each light cup 84, the reflected light from one light cup 84 may typically be directional and separated from the reflected light from the adjacent light cup 84. It may also be understood that the intensity and area of the reflected illumination on the light transmissive IML 63 may be determined by at least one of the location of the illuminating devices 72 relative to the light cup 84, the geometrical parameters of the light cup 84, the size/location of the openings 74 adjacent to the illumination devices 72, thickness of the IML assembly 40 or the like.

Figure 7:
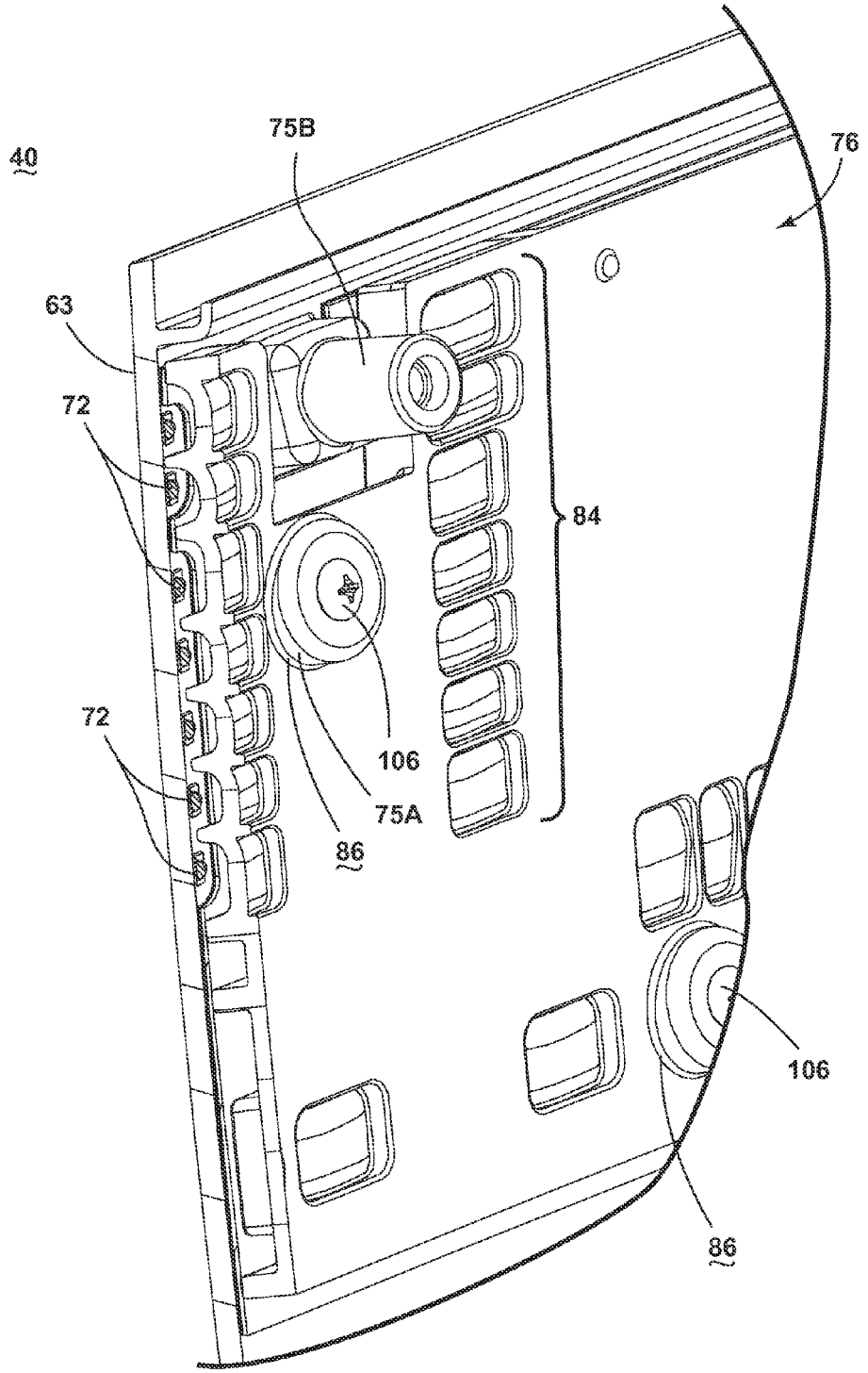
FIG. 7 is an enlarged perspective partial view of the indicia assembly of FIG. 3, where a light reflector is coupled to the indicia assembly by means of one or more fasteners.

FIG. 7 illustrates a perspective partial view of the indicia assembly 40, where the light reflector 76 is coupled to an IML 63 by the attachment means. As illustrated, the openings 86 formed on the light reflector 78 may receive the bores 75A formed on the rear side of the IML 63 to mechanically couple the light reflector 78 and the IML 63 by means of the screw 106.

Figure 8:
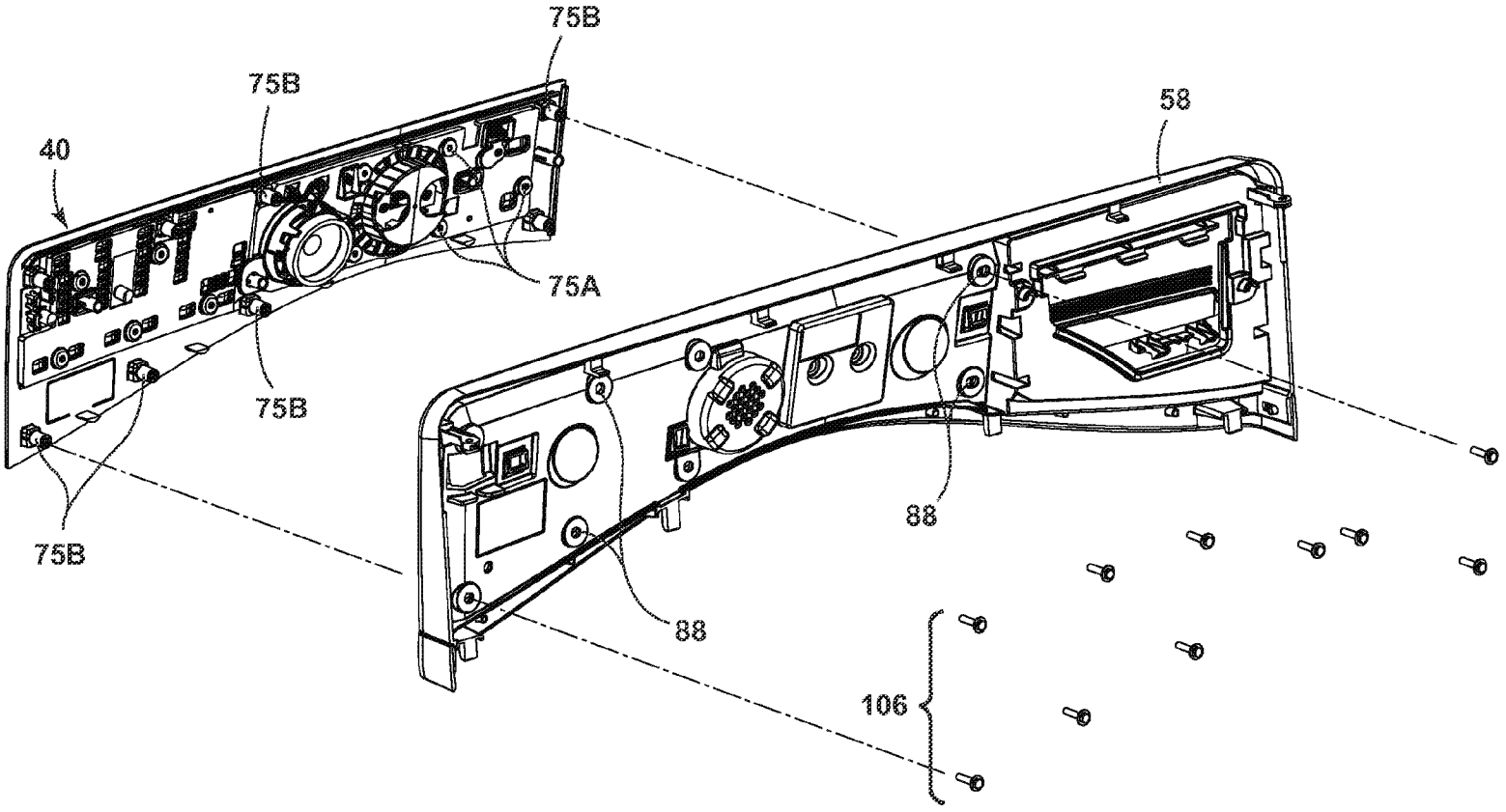
FIG. 8 is an exploded, rear perspective view of the console assembly of FIG. 2, illustrating the coupling between the indicia assembly and the console shell, where the indicia assembly includes a plurality of bores for receiving fasteners.

Referring to FIG. 8, the coupling between the IML assembly 40 and the console shell 58 is illustrated. A plurality of bores 75B may extend from the rear side of the IML 63 for receiving openings 88 formed on the console shell 58. One or more snap fit mechanisms 90 may also be provided for further coupling between the console shell 58 and the IML assembly 40.

The console assembly of the appliance may be used to implement one or more embodiments of the invention. The console assembly may be used in providing controlled illumination to the user by mounting the illumination devices on the rear side of the PCA to illuminate light from the illumination devices toward the inner surface of the light cup, thereby reflecting the light by the inner surface of the light cup. A portion of the reflected light may pass through openings in the PCA and adhesive layer, and light transmissive IML to the user.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. As examples, the shape and geometrical dimension of light cups may be varied to provide controlled illumination to the user. The IML may include entirely touch circuits without any knobs or buttons.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A console assembly for an appliance comprising:

a light transmissive indicia assembly (IML) having at least one indicator and at least one operator control;

a printed circuit assembly (PCA) mounted to the IML, having a touch circuit on a first side adjacent to the IML, operatively coupled with the at least one operator control on the IML, and further having at least one light emitting diode (LED) on a second side opposite the first side, and at least one opening through the PCA from the second side to the first side;

a light reflector disposed adjacent to the second side of the PCA and comprising at least one dome shaped light cup disposed adjacent to and positioned to aligned with the at least one LED, wherein light from the LED is directed toward the light cup and reflected backward by the light cup through the at least one opening of the PCA and through the IML.

2. The console assembly according to claim 1 further comprising an attachment means.

3. The console assembly according to claim 2 wherein the attachment means includes an adhesive.

4. The console assembly according to claim 3 wherein the adhesive is pressure sensitive adhesive (PSA).

5. The console assembly according to claim 1 further comprising a console shell and an encoder PCA mounted on a first side of the console shell.

6. The console assembly according to claim 1 wherein the PCA has a plurality of LEDs and the light reflector has a plurality of cups, each cup being disposed adjacent to an LED.

7. The console assembly according to claim 1 wherein the light reflector is mounted to the IML, through the PCA.

8. The console assembly according to claim 1 wherein the light reflector is coupled to the IML by means of one or more fasteners.

9. The console assembly according to claim 8 wherein the least one fastener is a screw.

10. The console assembly according to claim 1 further comprising a console shell coupled to the IML by means of one or more fasteners.

11. The console assembly according to claim 10 wherein the least one fastener is a screw.

12. The console assembly according to claim 1 further comprising an encoder.

13. The console assembly according to claim 1 wherein the IML, comprises one of polyester, Polyvinyl Chloride (PVC), or acrylonitrile butadiene styrene (ABS).

14. The console assembly according to claim 1 wherein the PCA comprises one of CEM-1 (cotton paper and epoxy) or FR4 epoxy resin and fiberglass.

15. The console assembly according to claim 1 wherein the light reflector comprises one of acrylonitrile butadiene styrene (ABS), polypropylene (PP) or polycarbonate (PC).

16. The console assembly according to claim 10 wherein the console shell comprises one of flame retardant acrylonitrile butadiene styrene (FR ABS), Polyvinyl Chloride (PVC), or flame retardant polycarbonate/acrylonitrile butadiene styrene (FR PC-ABS).

17. The console assembly according to claim 1 wherein light from the LED is directed toward the dome shape of the light cup.

18. The console assembly according to claim 1 wherein the light cup defines a three dimensional space when the light reflector and PCA are aligned and the LED is received in the three dimensional space.

19. The console assembly according to claim 6 wherein the reflected light from one of the plurality of light cups is directional and separated from the reflected light from a cup adjacent from the one of the plurality of light cups.

* * * * *